United States Patent [19]

Tong

[11] 4,063,681

[45] Dec. 20, 1977

[54] MAIL BOX SIGNALLING MECHANISM

[76] Inventor: Frank C. Tong, 1064 MacDavidson Circle, Dacono, Colo. 80514

[21] Appl. No.: 683,919

[22] Filed: May 6, 1976

[51] Int. Cl.[2] ..... B65B 91/00

[52] U.S. Cl. ..... 232/34

[58] Field of Search ..... 232/1 C, 34, 35, 36

[56] References Cited

U.S. PATENT DOCUMENTS

| | | | |
|---|---|---|---|
| 1,123,647 | 1/1915 | Ackman | 232/34 |
| 1,904,448 | 4/1933 | Hampden | 232/35 |
| 2,002,423 | 5/1935 | Wade | 232/34 |
| 2,496,962 | 2/1950 | Shaw | 232/1 C |
| 3,080,107 | 3/1963 | Lindahl | 232/35 |
| 3,602,424 | 8/1971 | Raulston | 232/35 |
| 3,888,409 | 6/1975 | Bolduc | 232/35 |
| 3,891,139 | 6/1975 | Redling | 232/35 |

*Primary Examiner*—Roy D. Frazier
*Assistant Examiner*—Peter A. Aschenbrenner
*Attorney, Agent, or Firm*—William E. Hein

[57] ABSTRACT

An improved mail box signalling mechanism that may be quickly and easily installed on conventional rural mail boxes provides a flag that is automatically displayed when mail is deposited in the mail box by the postman to give the box holder a positive visual indication that mail has in fact been delivered.

1 Claim, 2 Drawing Figures

MAIL BOX SIGNALLING MECHANISM

BACKGROUND AND SUMMARY OF THE INVENTION

This invention relates generally to mail boxes and more particularly to mail boxes that are arranged to signal the presence of incoming mail that has been deposited therein.

Certain types of mail boxes have been proposed for use in the suburbs or rural areas, where the mail box is typically located some distance from the box holder's residence, to eliminate the necessity of physically checking the mail box to determine if any mail has been deposited by the postman. Those mail boxes have generally employed various signalling mechanisms to visually indicate the presence of incoming mail to the box holder. However, the signalling mechanisms so employed have been relatively complicated and expensive and, moreover, have been unreliable due to their susceptibility to undesired actuation, thus resulting in false indications of the presence of mail. In addition, those mechanisms have typically not been capable of distinguishing between incoming mail placed in the box by the postman and outgoing mail placed in the box by the box holder.

It is, therefore, the principal object of this invention to provide a simple, inexpensive, and reliable mail box signalling mechanism for supplying a positive visual indication of the presence of mail deposited by the postman.

It is another object of this invention to provide a mail box signalling mechanism arranged for quick and easy field adaptation to existing conventional mail boxes without interferring with the normal operation thereof.

It is yet another object of this invention to provide a mail box signalling mechanism that will not be falsely actuated by or interfere with outgoing mail that has been placed in the mail box for pickup by the postman.

It is a further object of this invention to provide a mail box signalling mechanism that will support outgoing mail in a convenient upright position for easy pickup by the postman.

Other and incidental objects of this invention will become apparent to those persons skilled in the art from an examination of the following detailed description and the accompanying drawings.

DESCRIPTION OF THE PREFERRED EMBODIMENT

Figure 1:
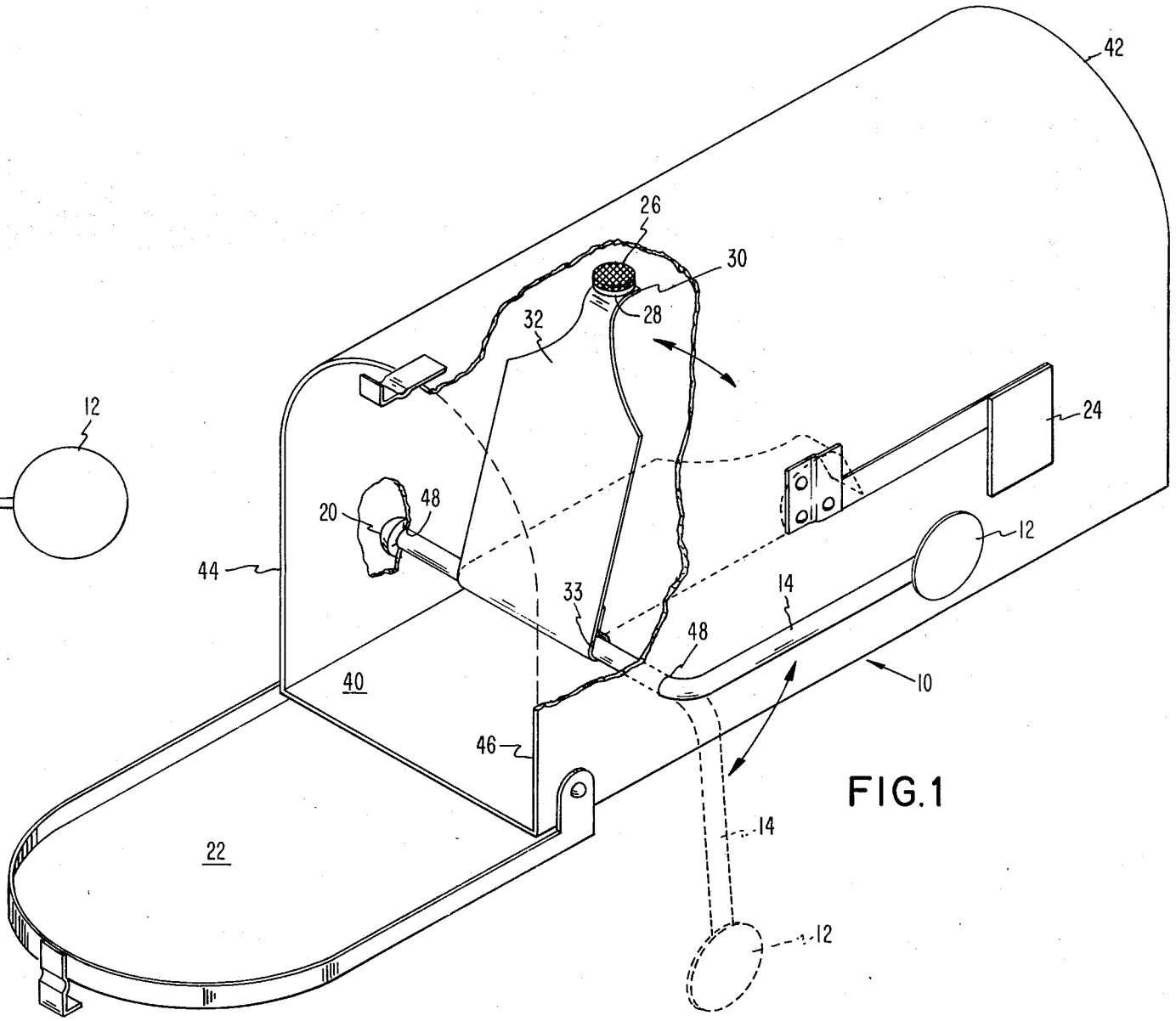
FIG. 1 is a pictorial view of a mail box illustrating the preferred embodiment of the present invention.
Figure 2:
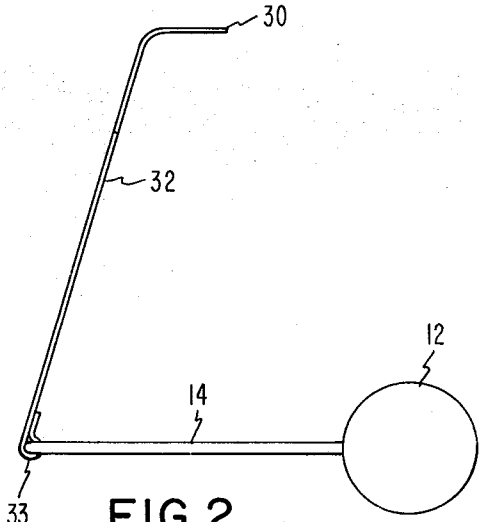
FIG. 2 is a detailed view of a portion of the signalling mechanism employed in the mail box of FIG. 1.

Referring now to FIG. 1, there is shown a typical rural mail box 10 having open and closed end portions, a bottom portion 40, a top portion 42, and left and right side portions 44 and 46, respectively. A hinged door 22 at the open end of mail box 10 is provided to allow access by the box holder and the postman. Mail box 10 may be constructed of any of a number of well known materials or combinations thereof including, for example, plastic, galvanized iron, and aluminum.

A rigid rectangular flag 24 is hingedly attached adjacent the right side 46 of mail box 10 in conformance with regulations of the U.S. Postal Service. Flag 24 is employed in a conventional manner by the box holder to signal the presence of outgoing mail to the postman. Flag 24 is generally red in color for better visibility and is displayed in an upright position by the box holder if outgoing mail is present.

Another flag 12, also brightly colored for better visibility, and preferably round in shape to readily distinguish it from conventional rectangular flag 24, is fixedly secured to one end of a flag rod 14. Flag rod 14, which may simply comprise a length of galvanized iron rod, is bent at a right angle to form an external portion and an internal portion thereof. The internal portion of flag rod 14 is supported for rotation by a pair of holes 48 provided in mail box sides 44 and 46. Each of the two holes 48 is spaced equidistantly back from the plane of the open end and equidistantly up from the bottom portion 40 of the mail box 10. A push nut 20 is applied to the other end of flag rod 14 external to side 44. Flag rod 14 may be positioned so that flag 12 is adjacent to either the right side 46 of mail box 10, as illustrated, or to the left side 44.

A flat, generally rectangular push gate 32 includes a ferrous tab portion 30 at one end thereof. The other end of push gate 32 is formed so as to provide a sleeve 33 through which the internal portion of flag rod 14 passes. Push gate 32 is preferably somewhat narrower in width than that of mail box 10, as measured between sides 44 and 46, to permit outgoing mail to be placed in an upright position on either side of push gate 32 so that it may be conveniently accessed by the postman. Push gate 32 is rigidly fastened to the internal portion of flag rod 14, for example, by spot welding or by crimping the sleeve 33.

A permanent magnet 28 is fixedly mounted to the inside surface of the top portion 42 of mail box 10 at a point such that it holds push gate 32 in a nearly vertical position by contacting the ferrous tab portion 30 thereof. Permanent magnet 28 may be so mounted by means of an adhesive material 26 that may comprise, for example, a length of double-sided adhesive tape selected from several of the types commonly available. Ferrous tab portion 30 of push gate 32 is appropriately bent to contact a substantial portion of the exposed surface of permanent magnet 28 to insure a reliable magnetic contact. The angular relationship between flag rod 14 and push gate 32 is adjusted at the time sleeve 33 is crimped around the internal portion of flag rod 14 such that the external portion of flag rod 14 is substantially horizontal when tab portion 30 of push gate 32 is in contact with permanent magnet 28, as illustrated in FIG. 1.

Operation of the present mail box signalling mechanism is apparent from an examination of FIG. 1 of the appended drawing wherein it is clearly shown that the postman merely places any letters or other mail for delivery to the box holder into mail box 10 in the usual manner such that contact is made with push gate 32. This contact overcomes the magnetic force holding the tab portion 30 of push gate 32 against permanent magnet 28 such that push gate 32 is allowed to rotate into a substantially horizontal position with the delivered mail lying thereon. Rotation of push gate 32 in turn rotates flag arm 14, thereby swinging flag 12 into a position below mail box 10 as indicated by the dotted line representation thereof in FIG. 1.

At the time the delivered mail is removed from the mail box 10, the flag mechanism is reset by simply returning the external portion of flag rod 14 to the horizontal position, thus rotating push gate 32 so that its tab portion 30 comes into contact with permanent magnetic 28, in which position it is magnetically held until another mail delivery occurs.

Whenever outgoing mail is left for the postman, the box holder has only to open the door 22 of mail box 10 and place the mail in an upright position convenient for the postman on either or both sides of push gate 32. Conventional flag 24 is rotated to the upright position to signal the presence of outgoing mail to the postman.

It will be appreciated from the foregoing by those skilled in the art that the present mail box signalling mechanism accomplishes all of the stated objects of this invention, and others, including many of great practical utility and commercial importance.

I claim:

1. An improved mail box signalling mechanism in combination with a typical rural mail box of the type having a bottom portion, two upwardly extending parallel side portions, a curved top portion, and a hinged end portion, said signalling mechanism comprising:

a flag rod having a internal portion that is horizontally supported for rotation between the side portions, said flag rod including a flag arm portion external to the mail box, said flag arm portion being perpendicular to said internal portion of said flag rod and being arranged for rotation, in a substantially vertical plane adjacent to one of said side portion, between first and second display positions;

a generally flat, rectangular push gate within said mail box fixedly attached to said flag rod for hinged rotation in concert therewith, said push gate including a ferrous tab portion on one end thereof and being arranged to provide a space between each side thereof and the adjacent side portion of said mail box for supporting outgoing mail in an upright position convenient for removal by a postman;

a flag secured to the flag arm portion of said flag rod for providing a position visual indication to the box holder of the first and second display positions thereof; and magnetic latching means mounted on the inside surface of the top portion of said mail box positioned such that the ferrous tab portion of said push gate comes into contact with said magnetic latching means for releasably securing said push gate in a substantially vertical position such that said flag arm portion of said flag rod is held in said first display position;

said push gate being responsive to actuation by the postman at the time incoming mail is deposited in the mail box for rotation away from said magnetic latching means such that said flag arm portion of said flag rod is rotated to said second display position.

* * * * *